US010289029B2

(12) United States Patent
Okugawa

(10) Patent No.: US 10,289,029 B2
(45) Date of Patent: May 14, 2019

(54) DEVELOPING DEVICE WITH VIBRATION APPARATUS

(71) Applicant: Konica Minolta, Inc., Chiyoda-ku, Tokyo (JP)

(72) Inventor: Yuji Okugawa, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/656,019

(22) Filed: Jul. 21, 2017

(65) Prior Publication Data

US 2018/0024469 A1 Jan. 25, 2018

(30) Foreign Application Priority Data

Jul. 22, 2016 (JP) ..... 2016-144812
Oct. 19, 2016 (JP) ..... 2016-205049

(51) Int. Cl.
*G03G 15/08* (2006.01)

(52) U.S. Cl.
CPC ..... *G03G 15/0889* (2013.01)

(58) Field of Classification Search
CPC ..... G03G 15/0889
See application file for complete search history.

(56) References Cited

U.S. PATENT DOCUMENTS 5,970,290 A * 10/1999 Yoshiki ..... G03G 15/0868 399/261
6,215,974 B1 * 4/2001 Katoh ..... G03G 15/0875 399/258
6,708,007 B2 * 3/2004 Yamaguchi ..... G03G 15/0849 399/30
2005/0244193 A1 * 11/2005 Amano ..... G03G 15/0853 399/258
2009/0129822 A1 * 5/2009 Toh ..... G03G 15/0875 399/258
2009/0311015 A1 * 12/2009 Nakayama ..... G03G 15/2025 399/327

FOREIGN PATENT DOCUMENTS

JP 04026873 A * 1/1992
JP 04026873 A * 1/1992
JP 2007206453 A 8/2007
JP 2014199395 A * 10/2014
JP 2014199395 A * 10/2014

OTHER PUBLICATIONS

JP_04026873_A_T MachineTranslation, Saito, 1992, Japan.*
JP_2014199395_A_T Machine Translation, Koichi, Japan.*

* cited by examiner

*Primary Examiner* — Victor Verbitsky
(74) *Attorney, Agent, or Firm* — Cantor Colburn LLP

(57) ABSTRACT

A developing device includes: a housing that contains a developing agent; a vibrator that vibrates the housing; and a hardware processor that controls the vibrator at a time when no image is being formed, with the housing mounted on an image forming apparatus, to vibrate the housing such that toner adhered inside the housing is dropped.

18 Claims, 8 Drawing Sheets

DEVELOPING DEVICE WITH VIBRATION APPARATUS

CROSS-REFERENCE TO RELATED APPLICATIONS

The present invention claims priority under 35 U.S.C. § 119 to Japanese Patent Applications No. 2016-144812 filed on Jul. 22, 2016 and No. 2016-205049 filed on Oct. 19, 2016, including description, claims, drawings, and abstract the entire disclosure are incorporated herein by reference in its entirety.

BACKGROUND

Technological Field

The present invention relates to a developing device and an image forming apparatus.

Description of the Related Art

Image forming apparatuses (e.g., printers, copying machines, facsimiles) that use an electrophotographic process technology typically form an electrostatic latent image by irradiating (exposing) a charged photo-conductor drum (image carrier) with laser light based on image data. A developing device then supplies toner to the photo-conductor drum on which the electrostatic latent image has been formed to visualize the electrostatic latent image and form a toner image. This toner image is then transferred directly or indirectly to a sheet of paper and fixed at a fixing nip by being heated and pressurized to form the toner image on the sheet of paper.

In such image forming apparatuses, a developing agent that is contained in a housing, which constitutes the developing device, is carried by a developer sleeve (developing agent carrier). The developer sleeve that carries the developing agent conveys the toner toward the photo-conductor drum while rotating. However, at this time the toner may be scattered due to the rotation of the developer sleeve. The scattered toner adheres, for example, to an upper wall of the housing around the developer sleeve. This toner may build up, clump and drop from the upper wall of the housing. If, for example, the dropped toner adheres to the developer sleeve or the photo-conductor drum during an image forming process, image defects caused by the toner are likely to occur.

JP 2007-206453 A discloses a technique of vibrating the developing device by attaching and removing the developing device to cause the toner adhered to the upper wall of the housing that constitutes the developing device to drop from the housing.

However, in the configuration of JP 2007-206453 A, the developing device is vibrated by attaching and removing the developing device so that the developing device is vibrated only once a day at most. Consequently, image defects (toner spillage) caused by the toner can still occur if the toner that has built up on the upper wall of the housing of the developing device drops from the housing during the image forming process before the developing device is removed from the image forming apparatus.

Additionally, vibrating the developing device by attaching and removing the developing device may result in variations in the vibration operation depending on the user. Thus, the toner may not be dropped effectively from the housing, which may increase the likelihood that the toner spillage occurs.

SUMMARY

It is an object of the present invention to provide a developing device and an image forming apparatus.

To achieve the abovementioned object, according to an aspect of the present invention, a developing device reflecting one aspect of the present invention comprises:

a housing that contains a developing agent;

a vibrator that vibrates the housing; and a hardware processor that controls the vibrator at a time when no image is being formed, with the housing mounted on an image forming apparatus, to vibrate the housing such that toner adhered inside the housing is dropped.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
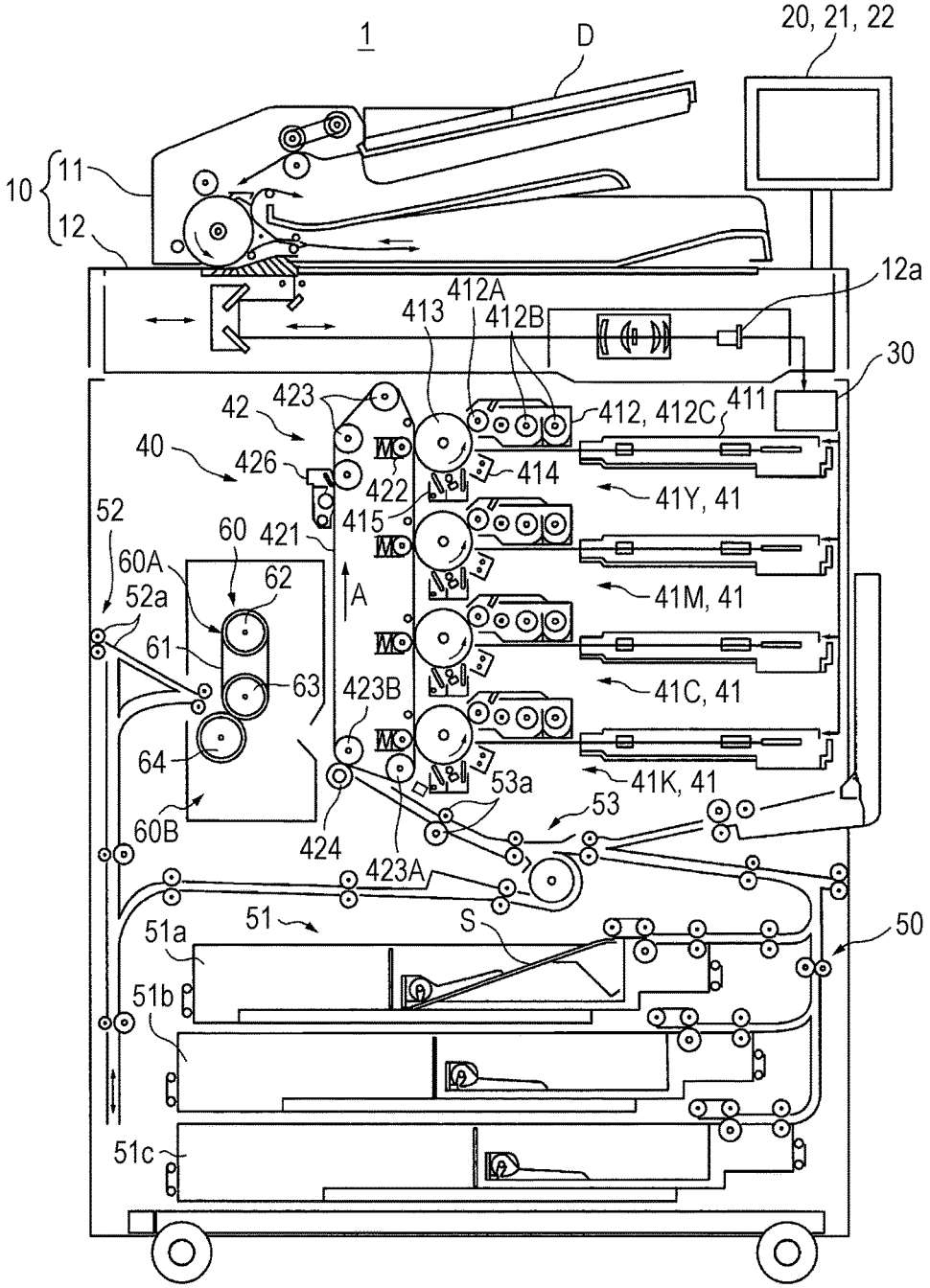
FIG. 1 is a diagram schematically showing an overall configuration of an image forming apparatus according to an embodiment.
Figure 2:
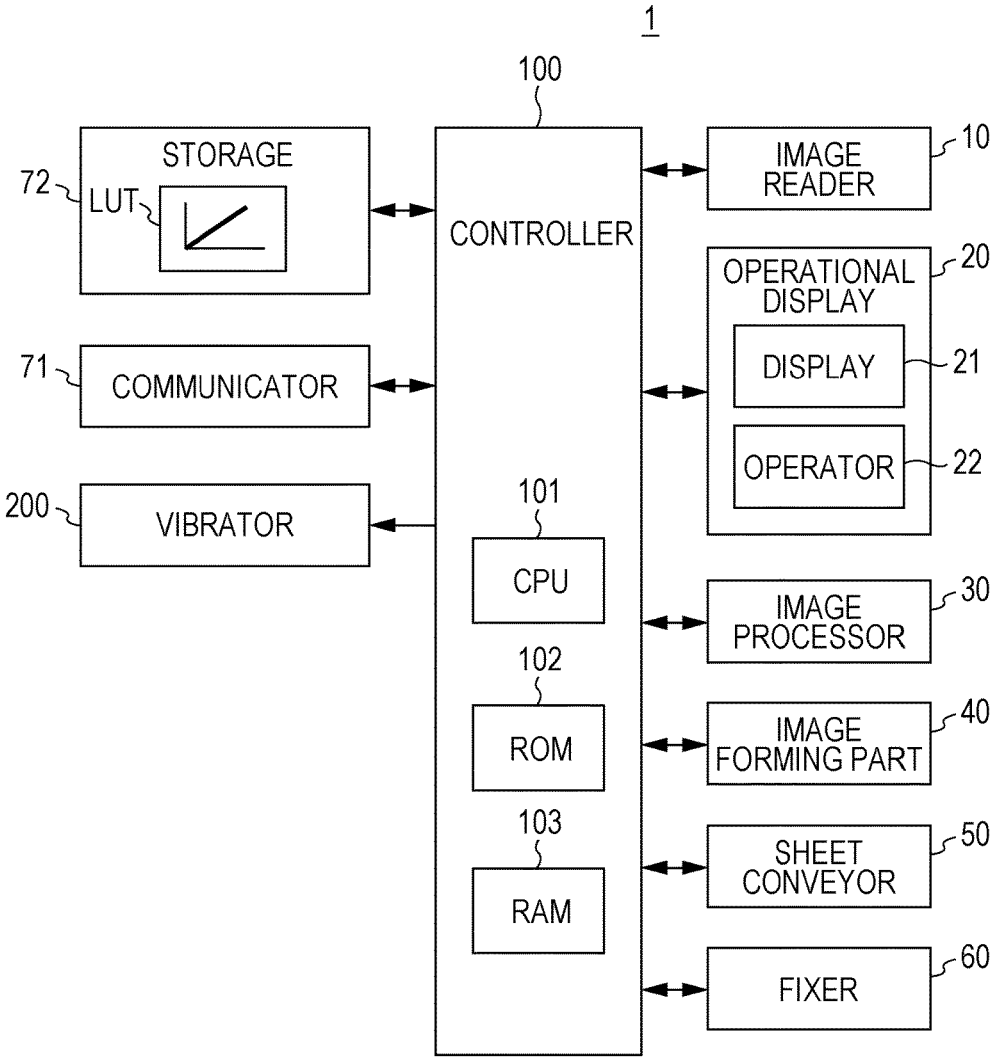
FIG. 2 is a diagram showing the major parts of a control system of the image forming apparatus according to the embodiment.

Hereinafter, one or more embodiments of the present invention will be described in detail with reference to the drawings. However, the scope of the invention is not limited to the disclosed embodiments. FIG. 1 is a diagram schematically showing an overall configuration of an image forming apparatus 1 according to the embodiment. FIG. 2 is a diagram showing the major parts of a control system of the image forming apparatus 1 according to the embodiment.

The image forming apparatus 1 shown in FIGS. 1 and 2 is an intermediate transfer type color image forming apparatus that uses an electrophotographic process technology. That is, the image forming apparatus 1 primarily transfers yellow (Y), magenta (M), cyan (C), and black (K) toner images that are formed on photo-conductor drums 413 to an intermediate transfer belt 421. After the toner images of the four colors are superimposed on the intermediate transfer belt 421, they are secondarily transferred to a sheet of paper S to form an image.

The image forming apparatus 1 employs a tandem system in which the photo-conductor drums 413 that correspond to the four colors, Y, M, C, and K, are arranged in series in a direction of travel of the intermediate transfer belt 421 and each color toner image is sequentially transferred to the intermediate transfer belt 421 in a single procedure.

The image forming apparatus 1 includes an image reader 10, an operational display 20, an image processor 30, an image forming section 40, a sheet conveyor 50, a fixer 60, and a controller 100.

The controller 100 includes, for example, a central processing unit (CPU) 101, a read only memory (ROM) 102, and a random access memory (RAM) 103. The CPU 101 retrieves programs that correspond to the content of the processes from the ROM 102, deploys them in the RAM 103, and centrally controls operations of each block of the image forming apparatus 1 in conjunction with the deployed programs. In doing so, various data stored in a storage 72 is referred to. The storage 72 is configured, for example, with a nonvolatile semiconductor memory (so-called flash memory) and a hard disk drive.

The controller 100 transmits and receives various data, via a communicator 71, between an external device (e.g., a personal computer) that is connected to a communication network such as a local area network (LAN) or a wide area network (WAN). The controller 100, for example, receives image data (input image data) transmitted from the external device and causes an image to be formed on the sheet of paper S based on this image data. The communicator 71 is configured with a communication control card such as a LAN card.

The image reader 10 includes, for example, an automatic document feeding device 11 referred to as an auto document feeder (ADF) and a document image scanning device 12 (scanner).

The automatic document feeding device 11 conveys a document D placed on a document tray to the document image scanning device 12 by a conveyance mechanism. The automatic document feeding device 11 enables images (including images on both sides) of multiple sheets of the document D that are placed on the document tray to be sequentially read at once.

The document image scanning device 12 optically scans a document conveyed from the automatic document feeding device 11 onto a contact glass or a document placed on the contact glass, and causes light reflected from the document to form an image on a receiving surface of a charge coupled device (CCD) sensor 12*a* to read a document image. The image reader 10 generates input image data based on a reading result from the document image scanning device 12. To this input image data, predetermined image processing is applied at the image processor 30.

The operational display 20 is configured, for example, with a liquid crystal display (LCD) having a touch panel and functions as a display 21 and an operator 22. According to display control signals input from the controller 100, the display 21 displays, for example, various operation screens, conditions of an image, operating status of functions, and information within the image forming apparatus 1. The operator 22 includes various operational keys such as a numeric keypad and a start key, and receives various input operations from a user and outputs operation signals to the controller 100.

The image processor 30 includes, for example, a circuit for performing, on the input image data, digital image processing according to default settings or user settings. For example, the image processor 30 performs tone correction based on tone correction data (tone correction table) under control of the controller 100. Besides the tone correction, the image processor 30 subjects the input image data, for example, to various kinds of correction processing including color correction and shading correction, and compression processing. The image forming section 40 is controlled based on the image data subjected to such processing.

The image forming section 40 includes, for example, image forming units 41Y, 41M, 41C, and 41K for forming images with respective color toners of a Y component, M component, C component, and K component based on the input image data, and an intermediate transfer unit 42.

The image forming units 41Y, 41M, 41C, and 41K for the Y component, M component, C component, and K component have a similar configuration. For ease of illustration and description, common elements are represented by the same reference numerals, and where the elements are differentiated, Y, M, C, or K is added to the reference numerals. In FIG. 1, reference numerals are given only to the elements of the image forming unit 41Y for the Y component and are omitted for the elements of the other image forming units 41M, 41C, and 41K.

The image forming unit 41 includes, for example, an exposure device 411, a developing device 412, the photo-conductor drum 413, a charging device 414, and a drum cleaning device 415.

The photo-conductor drum 413 is, for example, a negatively charged organic photo-conductor (OPC) in which an under coat layer (UCL), a charge generation layer (CGL), and a charge transport layer (CTL) are sequentially stacked on a peripheral surface of an aluminum conductive cylindrical body (aluminum pipe stock). The photo-conductor drum 413 corresponds to an "image carrier" of the present invention.

The charging device 414 generates a corona discharge to uniformly negatively charge a surface of the photo-conductor drum 413.

The exposure device 411 is configured, for example, with a semiconductor laser, and irradiates the photo-conductor drum 413 with laser light corresponding to the image of each color component. A positive charge is generated in the charge generation layer of the photo-conductor drum 413 and transported to a surface of the charge transport layer so that surface charge (negative charge) of the photo-conductor drum 413 is neutralized. On the surface of the photo-conductor drum 413, an electrostatic latent image of each color component is formed due to electrical potential difference with its surroundings.

The developing device 412 is a two-component reverse type developing device in which each color component toner is deposited on the surface of the photo-conductor drum 413 to visualize the electrostatic latent image and form the toner image. The developing device 412 supplies toner contained in a developing agent to the photo-conductor drum 413 to form the toner image on the surface of the photo-conductor drum 413.

The developing device 412 is provided with a developer sleeve 412A and a stirring member 412B. The developer sleeve 412A carries the developing agent while rotating and supplies the toner contained in the developing agent to the photo-conductor drum 413. The stirring member 412B stirs the developing agent in the developing device 412 by conveying the developing agent in an axial direction. The developer sleeve 412A corresponds to a "developing agent carrier" of the present invention.

Figure 3A:
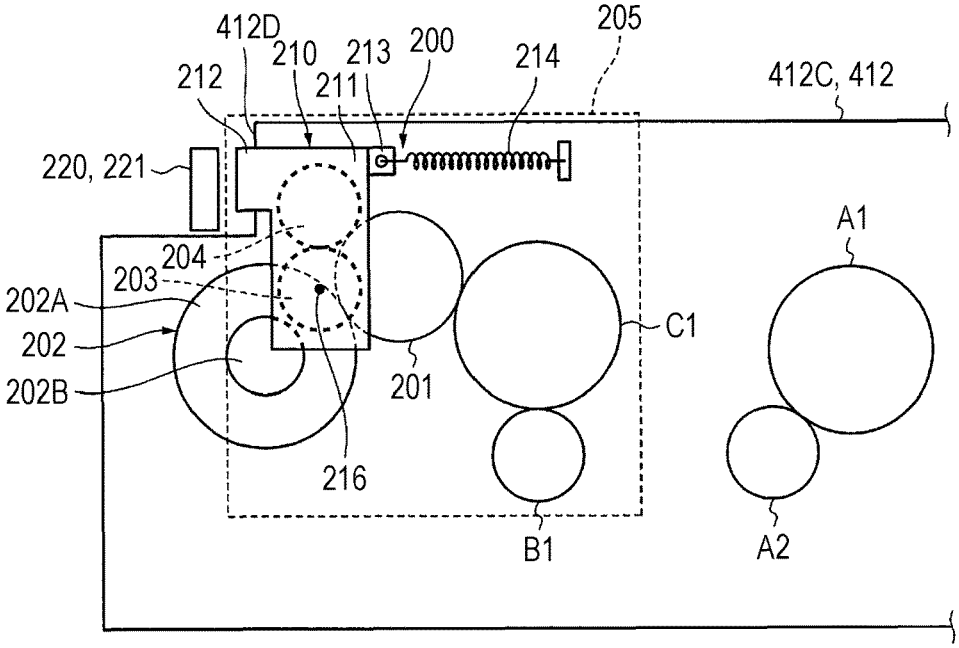
FIGS. 3A and 3B are side views of a developing device with a vibrator attached.
Figure 3B:
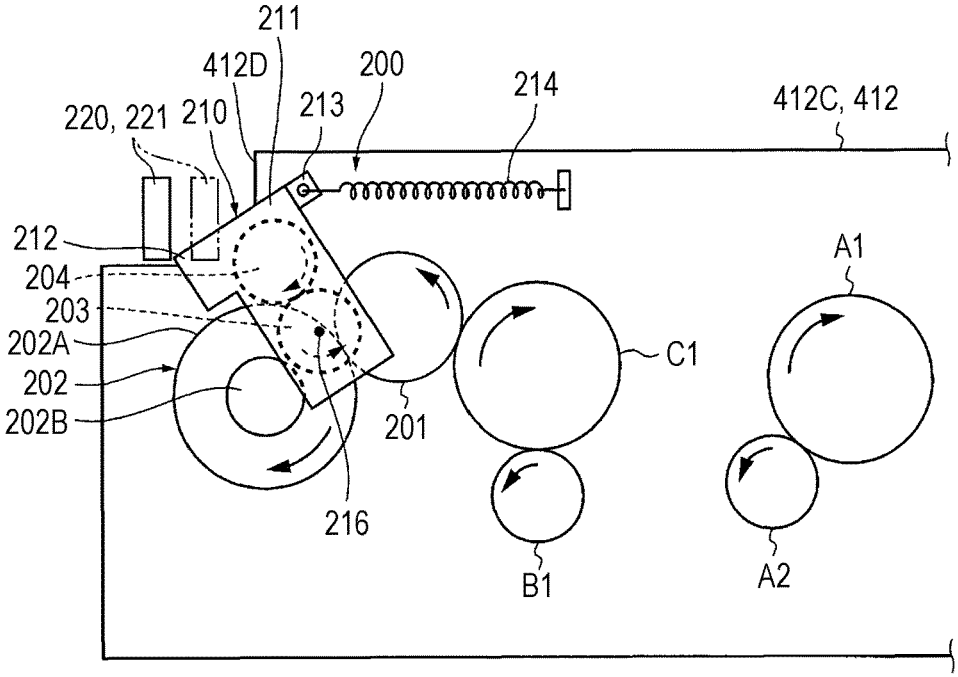

As shown in FIGS. 2, 3A, and 3B, the developing device 412 is provided with a vibrator 200 for vibrating the developing device 412. The vibrator 200 will be described below.

As shown in FIG. 1, the drum cleaning device 415 has, for example, a drum cleaning blade in sliding contact with the surface of the photo-conductor drum 413, and removes residual toner remaining on the surface of the photo-conductor drum 413 after the primary transfer.

The intermediate transfer unit 42 includes, for example, the intermediate transfer belt 421, a plurality of primary transfer rollers 422, a plurality of support rollers 423, a secondary transfer roller 424, and a belt cleaning device 426.

The intermediate transfer belt 421 is an endless belt that is looped around the plurality of support rollers 423. At least one of the plurality of support rollers 423 is a driving roller and the others are driven rollers. The intermediate transfer belt 421 travels in a direction A at a constant speed due to rotation of the driving roller. The intermediate transfer belt 421 is a belt having conductivity and elasticity, and is rotatably driven by a control signal from the controller 100.

The primary transfer rollers 422 are arranged on an inner surface side of the intermediate transfer belt 421 opposite the photo-conductor drums 413 of the corresponding color components. The primary transfer rollers 422 are pressed against the photo-conductor drums 413 with the intermediate transfer belt 421 interposed therebetween. Thus, primary transfer nips for the primary transfer of the toner images from the photo-conductor drums 413 to the intermediate transfer belt 421 are formed.

The secondary transfer roller 424 is arranged on an outer surface side of the intermediate transfer belt 421 opposite a backup roller 423B that is arranged downstream of a driving roller 423A in the belt travel direction. The secondary transfer roller 424 is pressed against the backup roller 423B with the intermediate transfer belt 421 interposed therebetween. Thus, a secondary transfer nip for the transfer of the toner image from the intermediate transfer belt 421 to the sheet of paper S is formed.

The belt cleaning device 426 removes the residual toner remaining on the surface of the intermediate transfer belt 421 after the secondary transfer.

When the intermediate transfer belt 421 passes through the primary transfer nips, the toner images on the photo-conductor drums 413 are successively laid on top of each other on the intermediate transfer belt 421 for primary transfer. Specifically, a primary transfer bias is applied to the primary transfer rollers 422 and an electric charge of opposite polarity to that of the toner is applied to a rear surface of the intermediate transfer belt 421, that is, the side thereof that comes into contact with the primary transfer rollers 422 so that the toner images are electrostatically transferred to the intermediate transfer belt 421.

Subsequently, when the sheet of paper S passes through the secondary transfer nip, the toner images on the intermediate transfer belt 421 are secondarily transferred to the sheet of paper S. Specifically, a secondary transfer bias is applied to the backup roller 423B and an electric charge of the same polarity as that of the toner is applied to a front surface of the sheet of paper S, that is, the side thereof that comes into contact with the intermediate transfer belt 421 so that the toner images are electrostatically transferred to the sheet of paper S.

The fixer 60 includes, for example, an upper fixer 60A that has fixing surface side members which are arranged on a side of the sheet of paper S on which the toner image is formed which is a fixing surface of the sheet of paper S, and a lower fixer 60B that has a rear surface side support member which is arranged on the opposite side of the fixing surface which is the rear surface of the sheet of paper S. The rear surface side support member is pressed against the fixing surface side members so that a fixing nip that sandwiches and conveys the sheet of paper S is formed.

The fixer 60 heats and pressurizes, at the fixing nip, the conveyed sheet of paper S on which the toner images have been secondarily transferred and fixes the toner images on the sheet of paper S.

The upper fixer 60A has an endless fixing belt 61, a heated roller 62, and a fixing roller 63, which are the fixing surface side members. The fixing belt 61 is looped around the heated roller 62 and the fixing roller 63.

The lower fixer 60B has a pressure roller 64, which is the rear surface side support member. The pressure roller 64 forms the fixing nip between the fixing belt 61 to sandwich and convey the sheet of paper S.

The sheet conveyor 50 includes, for example, a paper feed unit 51, a paper output unit 52, and a conveyance path unit 53. The paper feed unit 51 has three paper feed tray units 51*a* to 51*c* in which a plurality of the sheets of paper S (standard paper, specialty paper) which are distinguished based on basis weight, size, or the like, are contained in accordance with preset paper type.

The conveyance path unit 53 has, for example, a plurality of conveyance roller pairs such as a resist roller pair 53*a*. The sheets of paper S contained in the paper feed tray units 51*a* to 51*c* are sent out one by one from the top and are conveyed to the image forming section 40 by the conveyance path unit 53. At this point, a resist roller unit in which the resist roller pair 53*a* is disposed corrects tilt of the fed sheet of paper S and adjusts the conveyance timing. Subsequently, in the image forming section 40, the toner images of the intermediate transfer belt 421 are secondarily transferred at once to one side of the sheet of paper S and are subjected to a fixing step in the fixer 60. The sheet of paper S on which an image has been formed is output outside of the apparatus by the paper output unit 52 which includes an output roller 52*a*.

In the developing device 412, when the developer sleeve 412A carrying the developing agent conveys the toner toward the photo-conductor drum 413, the toner may be scattered due to the rotation of the developer sleeve 412A. The scattered toner adheres to an upper wall of a housing 412C facing the developer sleeve 412A. As the toner builds up on the upper wall of the housing 412C, the toner clumps and drops from the upper wall of the housing 412C. If, for example, the dropped toner adheres to the developer sleeve 412A or the photo-conductor drum 413 during an image forming process, image defects caused by the toner are likely to occur.

Thus, in this embodiment, under the control of the controller 100, the vibrator 200 vibrates the housing 412C of the developing device 412 when no image is being formed, with the housing 412C mounted on the image forming apparatus 1, to cause the toner adhered to the upper wall of the housing 412C to drop from the upper wall of the housing 412C. This prevents the toner from dropping onto the developer sleeve 412A or the photo-conductor drum 413 during the image forming process, thereby preventing or reducing the occurrence of image defects caused by the toner. The vibrator 200 will now be described.

Figure 4A:
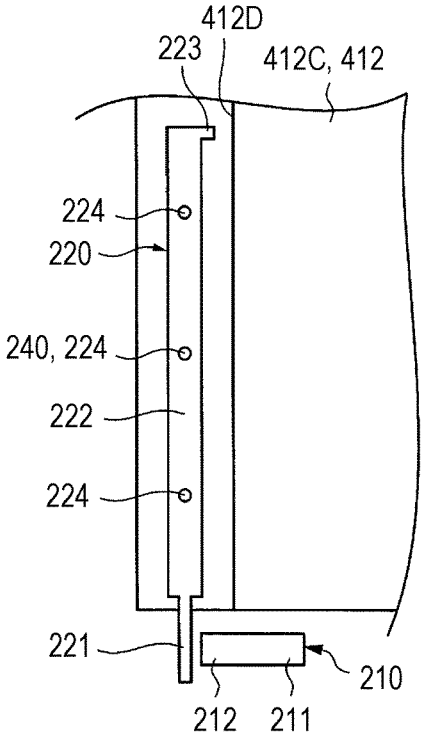
FIGS. 4A and 4B are top views of the developing device with the vibrator attached.
Figure 4B:
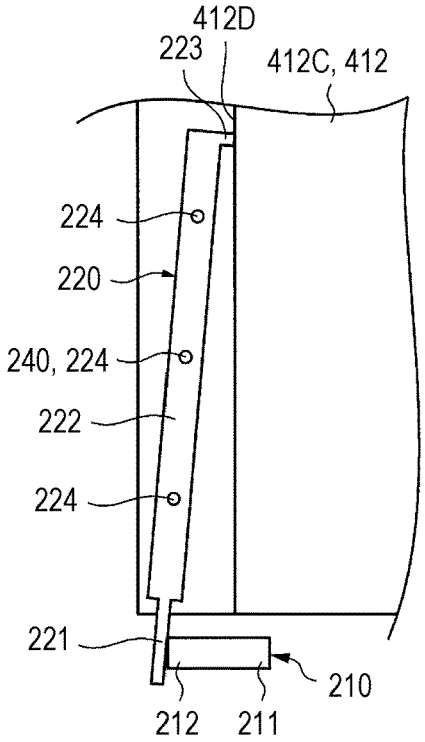

FIG. 3A is a side view of the developing device 412 with the vibrator 200 attached and is a diagram showing the developing device 412 not operating. FIG. 3B is a side view of the developing device 412 with the vibrator 200 attached and is a diagram showing the developing device 412 when operated. FIG. 4A is a top view of the developing device 412 with the vibrator 200 attached and is a diagram showing the developing device 412 not operating. FIG. 4B is a top view of the developing device 412 with the vibrator 200 attached and is a diagram showing the developing device 412 when operated.

As shown in FIG. 3A, the vibrator 200 is provided on a side of the housing 412C of the developing device 412, and has a first gear 201, a second gear 202, a third gear 203, a fourth gear 204, a gear support unit 205, a pressing member 210, and a vibrating member 220.

The first gear 201 is a gear that meshes with an output gear C1 from which drive from a drive source such as a motor not shown is output, and is supported by the gear support unit 205.

The output gear C1 is a gear for transmitting the drive from the drive source to the stirring member 412B via, for example, an intermediate gear B1. The output gear C1 meshes with a gear mechanism not shown, and the drive from the drive source is transmitted from the gear mechanism.

In this embodiment, the drive from the same drive source is transmitted to the developer sleeve 412A and the stirring member 412B. To a developer gear A1 that inputs the drive into the developer sleeve 412A, the drive from the drive source is transmitted via an intermediate gear A2. To the intermediate gear A2, the drive is transmitted from a different gear mechanism from that of the output gear C1.

The second gear 202 is a two-stage gear that has a large diameter gear 202A and a small diameter gear 202B, and is supported by the gear support unit 205. The large diameter gear 202A meshes with the first gear 201. The small diameter gear 202B meshes with the third gear 203.

The third gear 203 and the fourth gear 204 mesh with each other and are arranged inside the pressing member 210 (a body 211). The third gear 203 corresponds to a "transmission gear" of the present invention.

The pressing member 210 is a member that presses the vibrating member 220 and has the body 211, a pressing portion 212, and a spring attaching portion 213. The body 211 surrounds the third gear 203 and the fourth gear 204 and rotatably supports the third gear 203 and the fourth gear 204.

The body 211 is supported by the gear support unit 205 via the third gear 203. In other words, the third gear 203 is supported by the gear support unit 205.

The fourth gear 204 is not supported by the gear support unit 205, but is supported only by the body 211 of the pressing member 210. The fourth gear 204 is rotatably supported by the body 211 so that a predetermined friction reaction force is exerted between the fourth gear 204 and the body 211. The predetermined friction reaction force is a frictional force greater than the force of the drive that tries to rotate the fourth gear 204 relative to the body 211 when the drive is transmitted to the third gear 203. When the drive is transmitted from the third gear 203 to the fourth gear 204, the predetermined friction reaction force is exerted so that the fourth gear 204 does not rotate relative to the body 211, but the fourth gear 204 and the body 211 pivot with rotation of the third gear 203. In other words, when the drive is transmitted to the third gear 203, the pressing member 210 pivots about a center of rotation 216 of the third gear 203 due to the predetermined friction reaction force exerted between the fourth gear 204 and the body 211.

The pressing portion 212 projects to the left from an upper end of the illustrated left side of the body 211. On the illustrated left side of the pressing portion 212, the vibrating member 220 (a pressed portion 221) is located. As shown in FIG. 3B, when the developing device 412 starts to operate, the third gear 203 starts to rotate via the output gear C1, the first gear 201, and the second gear 202. In this embodiment, the third gear 203 is set to rotate in a counter-clockwise direction. Due to the friction reaction force that is exerted between the body 211 of the pressing member 210 and the fourth gear 204, the pressing member 210 pivots in the counter-clockwise direction. That is, the pressing member 210 pivots in response to the rotational drive of the stirring member 412B. When the pressing member 210 pivots in the counter-clockwise direction, the pressing portion 212 presses the vibrating member 220 toward the illustrated left side.

The spring attaching portion 213 is provided on the illustrated right side of the body 211 and has one end of a spring 214 attached thereto. The other end of the spring 214 is attached to an appropriate location on the housing 412C of the developing device 412. The pressing member 210 is thus biased to pivot in a clockwise direction due to the spring 214. Consequently, when the drive of the developing device 412 is no longer transmitted to the third gear 203, the pressing member 210 returns from the position in FIG. 3B to the position in FIG. 3A due to a biasing force of the spring 214.

The gear support unit 205 is also configured to be capable of supporting the output gear C1 and the intermediate gear B1 in addition to the first gear 201, the second gear 202, and the third gear 203. Enabling the gear support unit 205 to support the output gear C1 and the intermediate gear B1 enables the vibrator 200 to be removed from the housing 412C of the developing device 412.

As shown in FIG. 4A, the vibrating member 220 is a member for vibrating the housing 412C of the developing device 412 and faces a wall to be vibrated 412D that extends downward continuous with an upper lid of the housing 412C of the developing device 412. The wall to be vibrated 412D is continuous with the opposite end of the housing 412C to that on which the developer sleeve 412A is arranged. The vibrating member 220 has the pressed portion 221, a pivoting portion 222, and a vibrating portion 223.

The pivoting portion 222 extends in a width direction of the developing device 412, that is, an axial direction of the stirring member 412B (hereinafter, simply "axial direction"). The pivoting portion 222 has a plurality of holes 224 formed aligned in the axial direction. A screw 240 is inserted into any one these holes 224 to screw the vibrating member 220 to the housing 412C of the developing device 412 so that the vibrating member 220 pivots about the part of the hole 224 into which the screw 240 is inserted as a pivot point. That is, the vibrating member 220 is configured to be capable of changing the pivot point.

By pivoting, the pivoting portion 222 is capable of moving between a vibrating position (position in FIG. 4B) in which the vibrating portion 223 is in contact with the wall to be vibrated 412D of the housing 412C for vibrating the housing 412C, and a non-vibrating position (position in FIG. 4A) in which the vibrating portion 223 is not in contact with the housing 412C for not vibrating the housing 412C. The vibrating member 220 is biased toward the axial direction by a spring not shown and thus, when the pressing member 210 is not pressing the pressed portion 221, the vibrating member 220 is positioned at the non-vibrating position.

The pressed portion 221 is located on one axial end of the pivoting portion 222, that is, on a side on which the pressing member 210 is arranged, and is a part that is pressed by the pressing portion 212 of the pressing member 210.

The vibrating portion 223 projects to the illustrated right from the other axial end of the pivoting portion 222, and when in the vibrating position, comes into contact with the wall to be vibrated 412D of the housing 412C.

When the pressing member 210 pivots due to the drive, the pressing portion 212 of the pressing member 210 presses the pressed portion 221 toward the illustrated left so that the vibrating member 220 pivots and moves from the non-vibrating position to the vibrating position. As a result, the vibrating portion 223 impacts the wall to be vibrated 412D of the housing 412C of the developing device 412 and vibrates the housing 412C of the developing device 412 to enable the toner adhered to the upper lid of the housing 412C of the developing device 412 to be dropped from the upper lid.

Operation of the developing device 412 according to this embodiment will now be described. As shown in FIGS. 3A and 3B, when the developing device 412 starts to operate, the drive is transmitted to the third gear 203 via the output gear C1, the first gear 201, and the second gear 202. When the drive is transmitted to the third gear 203, the body 211 of the pressing member 210 pivots in the counter-clockwise direction due to the predetermined friction reaction force that is exerted between the fourth gear 204 and the body 211. Thus, the pressing portion 212 of the pressing member 210 presses the pressed portion 221 of the vibrating member 220.

When the pressed portion 221 of the vibrating member 220 is pressed, the vibrating member 220 pivots and the vibrating portion 223 impacts the housing 412C of the developing device 412 to vibrate the housing 412C, as shown in FIGS. 4A and 4B. Thus, the housing 412C of the developing device 412 is vibrated when no image is being formed by the developing device 412, that is, during start-up of the developing device 412 so that the toner can be dropped reliably before operation of the image forming process begins at the developing device 412. This prevents or reduces the dropping of the toner onto the developer sleeve 412A or the photo-conductor drum 413 during the image forming process.

After the developing device 412 starts to operate, the pressing portion 212 of the pressing member 210 is fixed while remaining in contact with the pressed portion 221 of the vibrating member 220, and the third gear 203 and the fourth gear 204 continue to rotate in the positions in FIG. 3B. This suppresses unnecessary vibration by the vibrating member 220.

When the operation of the developing device 412 is stopped, the drive is no longer transmitted to the third gear 203. Thus, the body 211 of the pressing member 210 is biased by the spring 214 and rotates in the clockwise direction to return to the position in FIG. 3A. The vibrating member 220 is no longer pressed by the pressing member 210 and returns to the position in FIG. 4A. This enables the developing device 412 to be vibrated when the developing device 412 is started again.

Thus, according to this embodiment, when the drive is transmitted to the vibrator 200 at the start-up of the developing device 412, the housing 412C of the developing device 412 is vibrated. This prevents or reduces the dropping of the toner, inside the housing 412C, built up on the upper wall of the housing 412C of the developing device 412 during the image forming process. Consequently, the occurrence of image defects caused by the toner built up on the upper wall of the housing 412C is prevented or reduced.

Additionally, the vibrator 200 vibrates the housing 412C based on the drive for operating the developing device 412 so that compared to other configurations in which another drive source is added to operate the vibrator, space can be saved inside the image forming apparatus 1.

Additionally, the vibrator 200 vibrates the housing 412C of the developing device 412 so that compared to configurations in which a user causes the vibration, variations in the vibration operation is less likely to occur.

Additionally, the vibrator 200 is removable from the housing 412C of the developing device 412 so that the vibrator 200 can be provided to the market place as a retrofit depending on the level desired by the user. The vibrator 200 can also be easily replaced and can be used mounted on the developing device 412 only when necessary.

Since the upper lid of the housing 412C faces the developer sleeve 412A, the toner scattered from the developer sleeve 412A tends to adhere to the upper lid of the housing 412C. However, in this embodiment, the wall to be vibrated 412D that extends from the upper lid is vibrated so that the toner is effectively dropped from the upper lid. Furthermore, although the toner dropped from the upper lid adheres to the developer sleeve 412A and the photo-conductor drum 413, this occurs when no image is being formed, and the toner adhered to the photo-conductor drum 413 is collected by the drum cleaning device 415. Thus, no image defects occur.

Furthermore, since the pivot point of the pivoting portion 222 of the vibrating member 220 can be changed, intensity of the vibration during vibration by the vibrating member 220 can be adjusted by changing the pivot point. For example, to intensify the vibration, the hole 224 that is most proximate to the pressed portion 221 of the holes 224 formed on the pivoting portion 222 may be used, and to dampen the vibration, the hole 224 that is most proximate to the vibrating portion 223 of the holes 224 formed on the pivoting portion 222 may be used.

Furthermore, since the drive for operating the stirring member 412B is transmitted to the vibrator 200, if, for example, the stirring member 412B is stopped between sheets during continuous printing, the housing 412C is vibrated by the vibrator 200 when the operation of the stirring member 412B is started again to print the next sheet of paper S. This increases the number of vibrations to thereby prevent or reduce build-up of the toner in the housing 412C.

Incidentally, if, for example, all of the four developing devices 412 that contain different color toners have the same start timing, noise generated when vibrating the developing device 412 would be generated simultaneously at a plurality of the developing devices 412, causing the vibrating noise to be too loud.

Thus, in this embodiment, under the control of the controller 100, the start timing of each developing device 412 is controlled to be different. Specifically, the operation of the developing devices 412 are started sequentially from the developing device 412 located upstream in the direction of rotation of the intermediate transfer belt 421. That is, by starting the operation of the developing devices 412 from the developing device 412 that has finished operation for image formation, the noise that is generated during vibration is generated at different times so that the noise generated during vibration is reduced.

Additionally, the vibrating noise may be loud where the vibrating member 220 and the housing 412C of the developing device 412 are composed, for example, of metal. A noise reducing member for reducing the generation of noise may thus be provided on the vibrating portion 223 of the vibrating member 220 or on the housing 412C of the developing device 412 in a position that is vibrated. Consequently, the noise generated during vibration is reduced. It should be noted that a relatively hard resin member such as poron may be used as the noise reducing member, taking into account that the noise reducing member is used to vibrate the housing 412C of the developing device 412.

Figure 5A:
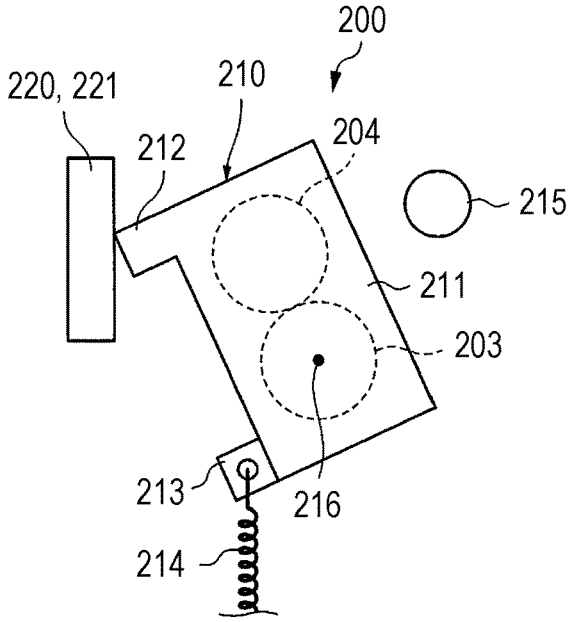
FIGS. 5A and 5B are diagrams showing a vibrator according to a first variation.
Figure 5B:
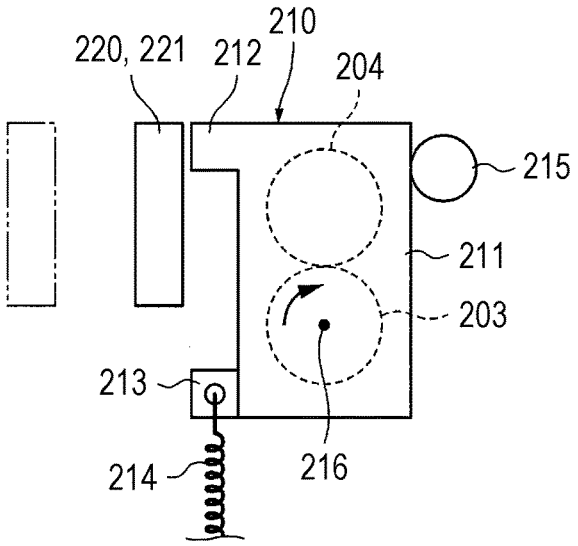

A first variation will now be described. FIG. 5A is a diagram showing a vibrator 200 of the first variation and is a diagram showing a developing device 412 not operating. FIG. 5B is a diagram showing the vibrator 200 of the first variation and is a diagram showing the developing device 412 at start-up.

As shown in FIG. 5A, a spring attaching portion 213 of a pressing member 210 of the first variation is located at a lower part of the illustrated left end of a body 211. A spring 214 has one end attached to the spring attaching portion 213 and the other end attached to an appropriate location on the developing device 412 below the pressing member 210. The pressing member 210 is thus biased to pivot in a counter-clockwise direction due to the spring 214. Consequently, when drive is not transmitted to a third gear 203, a pressing portion 212 of the pressing member 210 presses a vibrating member 220 so that the vibrating member 220 is in a vibrating position.

When the drive is transmitted to the third gear 203, the pressing member 210 pivots due to a predetermined friction reaction force that is exerted between a fourth gear 204 and the body 211. In the first variation, the third gear 203 is set to rotate in a clockwise direction.

As the pressing member 210 pivots, the pressing portion 212 moves away from a pressed portion 221 of the vibrating member 220 so that the vibrating member 220 is positioned in a non-vibrating position. In a location corresponding to the illustrated right side of the body 211 of the developing device 412, a stopper 215 is provided. The pressing member 210 is prevented from pivoting toward the downstream side of the stopper 215 by abutting against the stopper 215 and is thus in the position in FIG. 5B during operation of the developing device 412.

When operation of the developing device 412 is stopped, that is, when no image is being formed, the drive is not transmitted to the third gear 203 and the pressing member 210 pivots in the counter-clockwise direction due to a biasing force of the spring 214. The pressing portion 212 of the pressing member 210 thus presses the pressed portion 221 of the vibrating member 220, and the vibrating member 220 moves from the non-vibrating position to the vibrating position. As a result, a housing 412C of the developing device 412 is vibrated so that occurrence of image defects caused by toner adhered to the housing 412C is prevented or reduced.

In the above embodiment, the start timings of the operation of the developing devices 412 are controlled to be different so that the noise generated during vibration is generated at different times. However, in the first variation, the stop timings of the developing devices 412 are controlled to be different to enable the noise generated during vibration to be generated at different times.

Figure 6A:
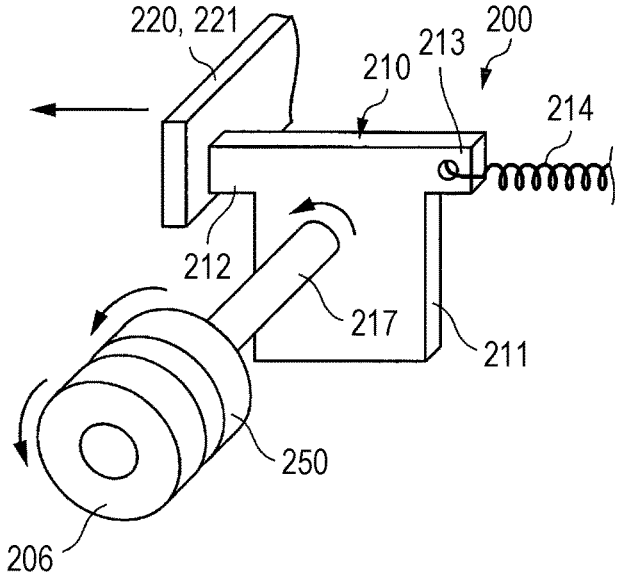
FIGS. 6A and 6B are diagrams showing a vibrator according to a second variation.
Figure 6B:
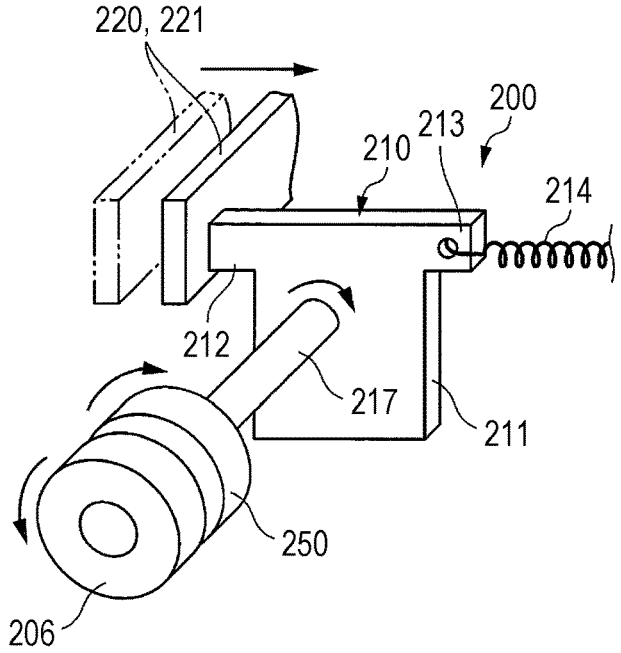

A second variation will now be described. FIG. 6A is a diagram showing a vibrator 200 of the second variation at start-up of the developing device 412. FIG. 6B is a diagram showing the vibrator 200 of the second variation when the developing device 412 is operating.

Unlike the above embodiment, a pressing member 210 of the second variation does not have gears arranged therein but has an overload protection part 250, as shown in FIG. 6A. The overload protection part 250 is disk-like, is connected to a pivot shaft 217 that extends from a body 211 of the pressing member 210, and rotates together with the pressing member 210.

The overload protection part 250 is in contact with a fifth gear 206 to which rotational drive of a stirring member 412B is transmitted. The overload protection part 250 rotates along with the fifth gear 206 due to a frictional force therebetween. When the fifth gear 206 continues to rotate and there is an overload on the overload protection part 250, torque transmission from the fifth gear 206 to the overload protection part 250 is interrupted. That is, due to the overload protection part 250, the rotational drive of the stirring member 412B is transmitted until rotational drive torque of the stirring member 412B exceeds a predetermined value, and when the rotational drive torque exceeds the predetermined value, the transmission of the rotational drive of the stirring member 412B is stopped.

In the second variation, the fifth gear 206 is set to rotate in a counter-clockwise direction. The pressing member 210 is thus biased to pivot in a clockwise direction due to a spring 214.

An operation of the second variation will now be described.

As shown in FIG. 6A, when drive is transmitted to the fifth gear 206 at the start-up of the developing device 412, the overload protection part 250 and the pressing member 210 pivot in the counter-clockwise direction along with the rotation of the fifth gear 206. When the pressing member 210 pivots in the counter-clockwise direction, a pressing portion 212 of the pressing member 210 presses a vibrating member 220 to vibrate the developing device 412.

When the developing device 412 continues to be operated and there is an overload on the overload protection part 250, transmission of the drive from the fifth gear 206 to the overload protection part 250 is stopped. The pressing member 210 then pivots in the clockwise direction and moves away from the vibrating member 220 due to a biasing force of the spring 214. As a result, the vibrating member 220 returns to a non-vibrating position. This stops the transmission of the drive to the vibrator 200 during the operation of the developing device 412, thereby enabling the load on the drive of the developing device 412 to be reduced.

Figure 7:
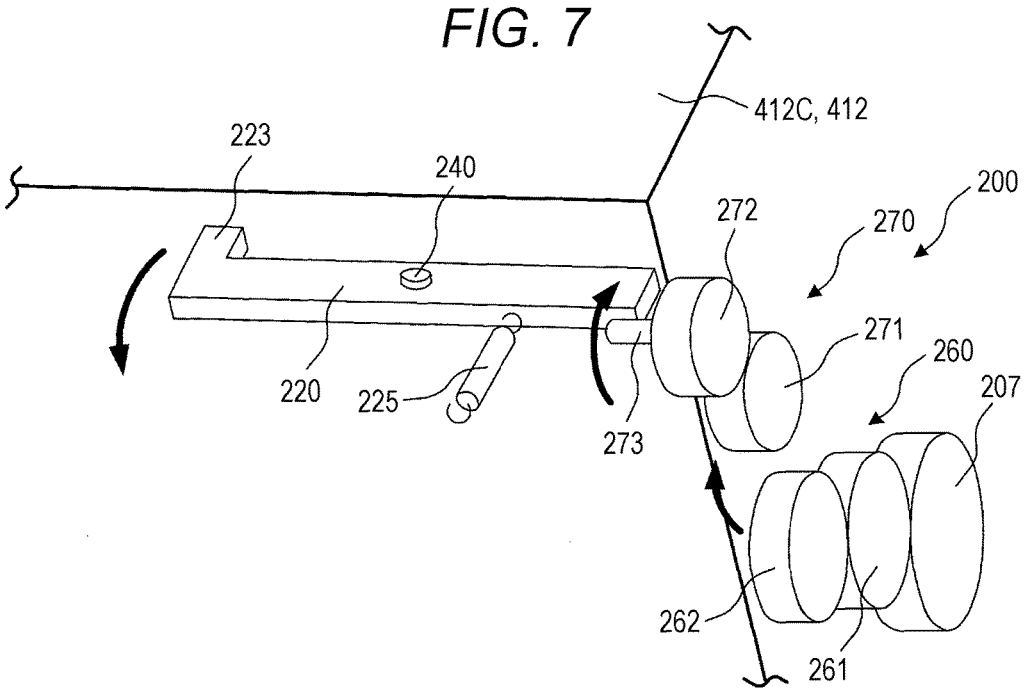
FIG. 7 is a diagram showing a vibrator according to a third variation.
Figure 8:
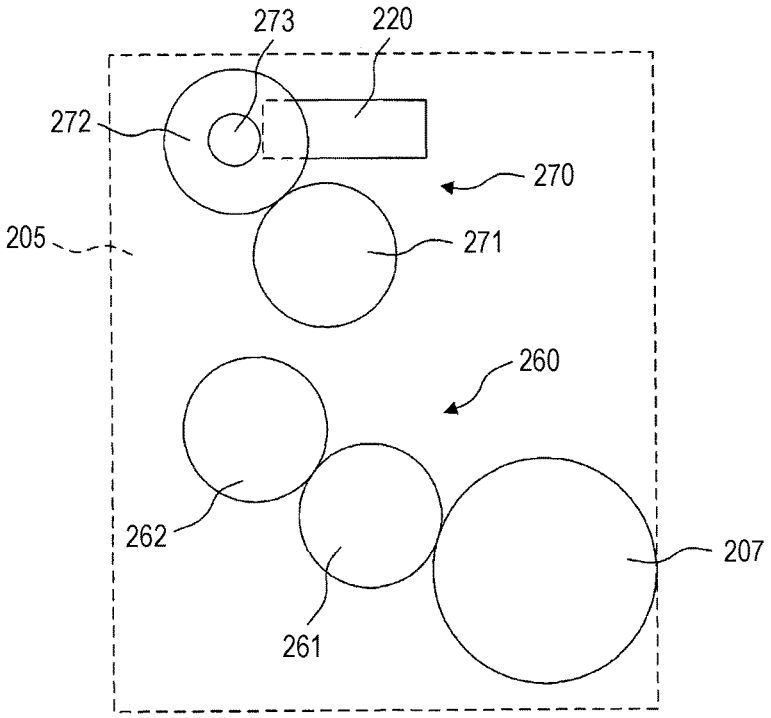
FIG. 8 is a diagram showing the vibrator according to the third variation when operation of the developing device is stopped.

A third variation will now be described. FIG. 7 is a diagram showing a vibrator 200 of the third variation. FIG. 8 is a diagram showing the vibrator 200 of the third variation when operation of a developing device 412 is stopped.

As shown in FIGS. 7 and 8, the vibrator 200 of the third variation has a gear support unit 205, a vibrating member 220, a transmission gear mechanism 260, and a pressing gear mechanism 270. The transmission gear mechanism 260 corresponds to a "transmitter" of the present invention.

The vibrating member 220 has substantially the same configuration as that of the above embodiment. The vibrating member 220 is biased against the developing device 412 at the opposite end to that of a vibrating portion 223 by a spring 225. Thus, when the vibrating member 220 is not being pressed by a pressing member 273 described below, the vibrating portion 223 is in contact with a housing 412C of the developing device 412.

The vibrating member 220 is supported by the gear support unit 205. The gear support unit 205 may be configured, for example, to have a support portion that supports, for example, a screw 240 that is the center of pivot of the vibrating member 220. The vibrator 200 that includes the vibrating member 220 is thus easily removable from the housing 412C.

The transmission gear mechanism 260 has a first fixed gear 261 and a first transfer gear 262. The first fixed gear 261 meshes with a transmission gear 207 to which rotational drive of the developing device 412 is transmitted and is rotatably and immovably supported by the gear support unit 205.

Figure 9:
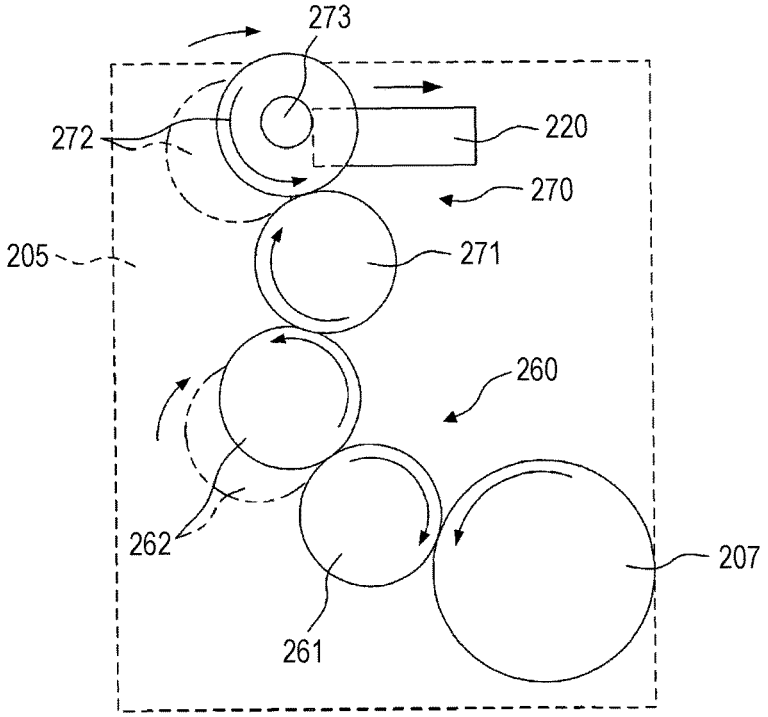
FIG. 9 is a diagram showing the vibrator according to the third variation when the developing device is operating.

The first transfer gear 262 meshes with the first fixed gear 261 and is rotatably and movably supported by the gear support unit 205. As shown in FIGS. 8 and 9, when the rotational drive is transmitted to the transmission gear 207, the first transfer gear 262 moves in the illustrated clockwise direction due to rotation of the first fixed gear 261 and meshes with a second fixed gear 271 described below.

The pressing gear mechanism 270 has the second fixed gear 271, a second transfer gear 272, and the pressing member 273. The second fixed gear 271 is a gear to which the rotational drive is transmitted from the transmission gear 207 via the transmission gear mechanism 260 when the second fixed gear 271 meshes with the first transfer gear 262 and is rotatably and immovably supported by the gear support unit 205.

The second transfer gear 272 meshes with the second fixed gear 271 and is rotatably and movably supported by the gear support unit 205. When the rotational drive is transmitted to the second fixed gear 271, the second transfer gear 272 moves in the illustrated clockwise direction due to rotation of the second fixed gear 271.

The pressing member 273 extends toward the developing device 412 from a part of the center of rotation of the second transfer gear 272 and is in contact with the opposite side surface of the vibrating member 220 to that of the developing device 412. The pressing member 273 presses the vibrating member 220 toward the developing device 412 due to movement of the second transfer gear 272. The vibrating portion 223 of the vibrating member 220 thus moves away from the housing 412C of the developing device 412. That is, the vibrating member 220 is in a non-vibrating position when being pressed by the pressing member 273.

Figure 10:
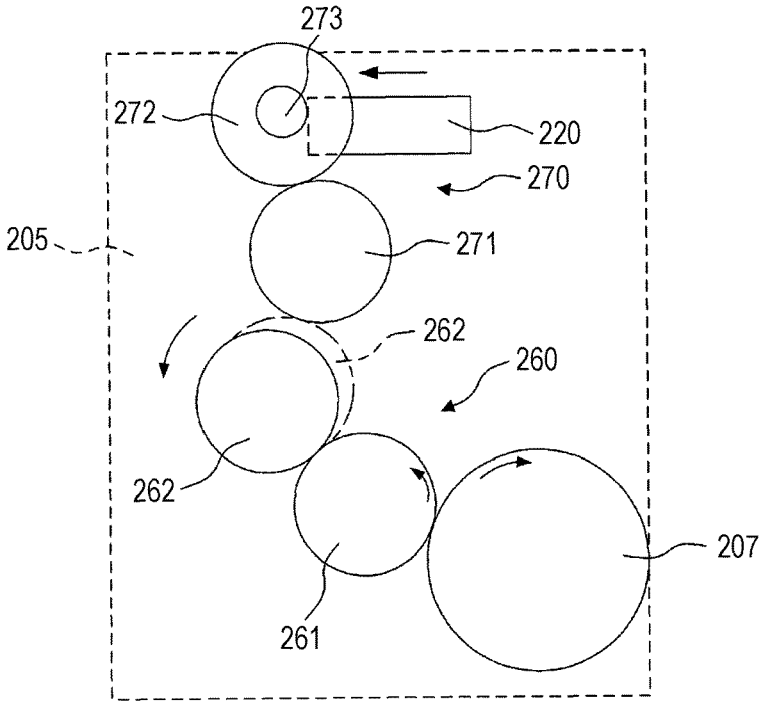
FIG. 10 is a diagram showing the vibrator according to the third variation when a pressing force by a pressing member is stopped.

As shown in FIG. 10, when the operation by the developing device 412 is stopped and the drive is not transmitted from the transmission gear mechanism 260 to the pressing gear mechanism 270, the pressing of the vibrating member 220 by the pressing member 273 is stopped. When the pressing by the pressing member 273 is stopped, the vibrating member 220 moves to push back the pressing member 273 due to a biasing force of the spring 225.

Thus, the vibrating portion 223 of the vibrating member 220 moves toward the housing 412C of the developing device 412 and vibrates the housing 412C. That is, the vibrating member 220 moves from the non-vibrating position to a vibrating position when the pressing by the pressing member 273 stops and vibrates the housing 412C. This enables toner adhered to an upper lid of the housing 412C of the developing device 412 to be dropped from the upper lid.

Additionally, when the controller 100 stops the pressing by the pressing member 273, the controller 100 causes the transmission gear 207 to rotate in the opposite direction to that in which the transmission gear 207 transmits the rotational drive. The rotation of the transmission gear 207 in this case is, for example, the rotation of one gear tooth. This enables the meshing of the first transfer gear 262 and the second fixed gear 271 to be released easily so that the vibrating operation by the vibrating member 220 is reliably performed. Furthermore, control by the controller 100 to stop the pressing by the pressing member 273 and to cause the transmission gear 207 to rotate in the opposite direction may be employed not only in the third variation but also in the above embodiment, the first variation, and the second variation.

Although in the above embodiment, the stirring member 412B is illustrated as a rotating member, the present invention is not limited thereto, and for example, the developer sleeve 412A may be employed as the rotating member. In this case, since the developer sleeve 412A typically remains rotating between sheets during continuous printing, the vibrating operation is performed either at start-up for a print job or when operation is stopped after the end of the print job. This prevents or reduces unnecessary vibrating operation in the case of a print job with a relatively small number of copies.

Additionally, although in the above embodiment, the wall to be vibrated 412D is located on the end of the upper wall of the housing 412C on the side of the stirring member 412B, the wall to be vibrated 412D may be the upper lid itself of the housing 412C, or may be located on the end of the upper wall of the housing 412C on the side of the developer sleeve 412A. In this way, the wall to be vibrated 412D will be located near the developer sleeve 412A so that the toner can be more effectively dropped from the housing 412C.

Additionally, although in the above embodiment, the vibrator 200 is configured to rotate in response to the rotational drive of the stirring member 412B, that is the rotating member that is used to perform a development operation of the developing device 412, the present invention is not limited thereto. For example, the vibrator 200 may be configured to have drive transmitted from a different drive source to that of the developing device 412. In this case, taking into account the difference between color printing and monochrome printing, only the housing 412C of the developing device 412 that is operated may be controlled to be vibrated.

Although embodiments of the present invention have been described and illustrated in detail, it is clearly understood that the same is by way of illustration and example only and not limitation, the scope of the present invention should be interpreted by terms of the appended claims. That is, the present invention may be embodied in various forms without departing from its spirit or essential characteristics.

What is claimed is:

1. A developing device comprising:

a housing that contains a developing agent;

a rotating member disposed in the housing;

a vibrator that vibrates the housing; and a hardware processor that urges operation of the vibrator at a time when no image is being formed, with the housing mounted on an image forming apparatus, to vibrate the housing such that toner adhered inside the housing is dropped;

wherein the vibrator vibrates the housing in response to stopping of a rotational drive of the rotating member used to perform a development operation of the developing device;

wherein the vibrator comprises:

a vibrating member movable between a vibrating position which is a position in contact with the housing for vibrating the housing and a non-vibrating position not in contact with the housing for not vibrating the housing; and a pressing member structured to press the vibrating member in response to stopping of operation of the rotational drive, the vibrating member being positioned in the non-vibrating position when not being pressed by the pressing member and being moved from the non-vibrating position to the vibrating position to vibrate the housing when pressed by the pressing member.

2. The developing device according to claim 1, wherein the vibrator is removable from the housing.

3. The developing device according to claim 1, wherein the time when no image is being formed is a time when the rotational drive is stopped.

4. The developing device according to claim 1, wherein the vibrator includes an overload protection part to which a rotational drive of a rotating member is transmitted until a rotational drive torque of the rotating member used to perform the development operation of the developing device exceeds a predetermined value, the transmission of the rotational drive of the rotating member being stopped when the rotational drive torque exceeds the predetermined value.

5. The developing device according to claim 1, wherein the time when no image is being formed is a time the rotational drive is stopped.

6. The developing device according to claim 1, further comprising a developing agent carrier that is provided inside the housing and carries and supplies the developing agent to an image carrier, wherein the rotating member is the developing agent carrier.

7. The developing device according to claim 1, further comprising a stirring member that stirs the developing agent inside the housing, wherein the rotating member is the stirring member.

8. The developing device according to claim 1, wherein the vibrator includes:

a vibrating member movable between a vibrating position which is a position in contact with the housing for vibrating the housing and a non-vibrating position not in contact with the housing for not vibrating the housing; and a pressing member for pressing the vibrating member based on the rotational drive, the vibrating member being positioned in the non-vibrating position when being pressed by the pressing member and being moved from the non-vibrating position to the vibrating position to vibrate the housing when the pressing by the pressing member is stopped.

9. The developing device according to claim 1, wherein the pressing member is configured to pivot in response to rotation of a transmission gear to which the rotational drive is transmitted, and presses the vibrating member by pivoting.

10. The developing device according to claim 9, wherein the vibrator further includes a transmitter that pivots in response to the rotation of the transmission gear, and transmits the rotational drive transmitted from the transmission gear to the pressing member by pivoting.

11. The developing device according to claim 1, wherein when the hardware processor signals to stop the pressing by the pressing member, the hardware processor causes the transmission gear to rotate in a direction opposite a direction in which the transmission gear to which the rotational drive is transmitted transmits the rotational drive.

12. The developing device according to claim 1, wherein the vibrating member extends in an axial direction of the rotating member and moves between the vibrating position and the non-vibrating position by pivoting about a predetermined position in the axial direction as a pivot point.

13. The developing device according to claim 12, wherein the vibrating member is configured to change a position of the pivot point by changing an attachment point of the vibrating portion to the developer housing.

14. The developing device according to claim 1, wherein the vibrating member includes a noise reducing member for reducing noise generated when the vibrating member vibrates the housing.

15. The developing device according to claim 1, wherein the vibrating member vibrates a wall to be vibrated extending continuously with an upper lid of the housing.

16. The developing device according to claim 15, further comprising a developing agent carrier that is provided inside the housing and carries and supplies the developing agent to the image carrier, wherein the wall to be vibrated is located near the developing agent carrier.

17. An image forming apparatus comprising the developing device according to claim 1.

18. The image forming apparatus according to claim 17, wherein a plurality of the developing devices are provided corresponding to a plurality of different colors, and the hardware processor controls the plurality of the developing devices so that at least one of start timings and stop timings of operation of the plurality of the developing devices are different.

* * * * *